US006669070B2

(12) United States Patent
Huang

(10) Patent No.: US 6,669,070 B2
(45) Date of Patent: Dec. 30, 2003

(54) TAPE DISPENSER

(76) Inventor: Harrison Huang, No. 23, Lin T'So Rd., Sheng Hsian, Taichung Hsien (TW)

( * ) Notice: Subject to any disclaimer, the term of this patent is extended or adjusted under 35 U.S.C. 154(b) by 45 days.

(21) Appl. No.: 10/078,427

(22) Filed: Feb. 21, 2002

(65) Prior Publication Data

US 2003/0155394 A1 Aug. 21, 2003

(51) Int. Cl.[7] ..... B65D 85/672; B26F 3/02
(52) U.S. Cl. ..... 225/56; 225/77; 225/81
(58) Field of Search ..... 225/65, 51, 47, 225/56, 79, 81, 6–92, 39, 46, 66, 88, 77

(56) References Cited

U.S. PATENT DOCUMENTS

| | | | | | |
|---|---|---|---|---|---|
| 2,609,877 | A | * | 9/1952 | Hanington | 225/25 |
| 3,895,059 | A | * | 7/1975 | Link | 156/527 |
| 4,627,560 | A | * | 12/1986 | Samuelson | 225/66 |
| 4,729,518 | A | * | 3/1988 | Mathna et al. | 242/422.4 |
| 5,071,051 | A | * | 12/1991 | Corbo et al. | 225/65 |
| 5,197,386 | A | * | 3/1993 | Lin | 101/213 |
| 5,393,367 | A | * | 2/1995 | Yu Chen | 156/523 |
| 5,802,695 | A | * | 9/1998 | Willoughby | 29/434 |
| D442,227 | S | * | 5/2001 | Carlson | D19/69 |
| 6,478,068 | B1 | * | 11/2002 | Brown | 156/577 |
| 2002/0079345 | A1 | * | 6/2002 | Shah | 225/51 |
| 2002/0131809 | A1 | * | 9/2002 | Han | 402/70 |
| 2002/0190091 | A1 | * | 12/2002 | Shah | 225/47 |

FOREIGN PATENT DOCUMENTS

| | | | | |
|---|---|---|---|---|
| FR | 562702 | * | 2/1923 | 225/67 |

* cited by examiner

*Primary Examiner*—Allan N. Shoap
*Assistant Examiner*—Ghassem Alie
(74) *Attorney, Agent, or Firm*—Browdy & Neimark

(57) ABSTRACT

An adhesive tape dispenser comprises a dispensing body and a blade. The dispensing body is of one-piece injection molded plastic construction and has a front portion for the mounting of the blade, two roll transport portions for rotatably fitting a roll of adhesive tape thereon, and at least one tensile anti-reverse member extended outward from the exterior surfaces of the roll transport portions and following the rotational direction of the adhesive tape roll during tape application. As such, the adhesive tape roll can be rotated forward to apply tape, but the adhesive tape roll cannot be easily rotated backward due to the braking action occurring at the rear extremity of the tensile anti-reverse member.

4 Claims, 7 Drawing Sheets

TAPE DISPENSER

FIELD OF THE INVENTION

The present invention relates generally to tape dispensing devices, and more particularly to an adhesive tape dispenser that prevents adhesive tape retraction and clinging, while also facilitating convenient adhesive tape roll reloading.

BACKGROUND OF THE INVENTION

As indicated in FIG. 1 and FIG. 2, a conventional adhesive tape dispenser 80 is comprised of a dispensing body 81 of one-piece injection molded plastic construction having a front portion 81, a side portion 83 extending contiguously back from each of the left and right ends of the front portion 11, and a roll transport portion 84 projecting inward from the interior lateral surface of each said side portion 83, wherein a vertical post 85 is disposed on the interior surface at the rear end of one roll transport portion 84 and a vertical hole 86 is formed on the interior surface at the rear end of the other roll transport portion 84, and a blade 87 mounted on the bottom surface of the dispensing body 81 front portion 81.

During utilization, the two side portions 83 are spread outward an appropriate degree and a roll of adhesive tape is rotatably placed onto the two roll transport portions 84 and then the post 85 is inserted into the hole 86 to conjoin the two roll transport portions 84 together, following which the adhesive tape is pulled forward to the bottom side of he said front portion 82 and the adhesive tape is applied onto an object as the tape dispenser 80 is moved backward such that the adhesive tape is continuously unrolled forward for application and finally cut by the blade 87.

The tape dispenser 80 has the advantages of structural simplicity and low production cost, but exhibits the following two shortcomings during utilization that await improvement:

1. Since the adhesive tape roll rotates freely on the roll transport portions 84, the rotational direction of the adhesive tape roll can be reversed due to angular disposition or an unanticipated application of external force, causing a small portion at the adhesive tape end of to spindle back and stick onto the circumferential surface of the adhesive tape roll; as such, it is necessary to undertake the troublesome ordeal of once again finding the end of the adhesive tape during usage.

2. The use of the vertical post 85 and vertical hole 86 to conjoin the two roll transport portions 84 achieves an approximate tangential relationship between the curved surfaces of the roll transport portions 84 and, furthermore, since the post 85 must be inserted upward into the bottom end of the hole 86, when the adhesive tape roll is loaded and the post 85 must be inserted into the hole 86 or the post 85 must be drawn out of the hole 86, the two roll transport portions 84 have to be radially aligned up and down a certain degree; however, since the roll transport portions 84 are conjoined under the inner circumferential surface of the adhesive tape roll., the alignment procedure is hampered by the inner circumferential surface of the adhesive tape roll such that loading the adhesive tape roll is difficult.

Referring to FIG. 3, it is an another similar type conventional adhesive tape dispenser 90, the physical structure resembles the previous dispenser, but has a check portion 92 disposed on the inner lateral surfaces towards the front end of each side portion 91 such that after the adhesive tape is cut, a small portion of it hangs down and sticks lightly onto the two check portions 92, thereby preventing the end of the adhesive tape from becoming retracted onto the circumferential surface of the adhesive tape roll. While this method reduces the occurrence of adhesive tape back spindling and sticking, any reverse rotation caused by an unintended application of force easily detaches the adhesive tape end from the check portions 92, which is then retracted onto the circumferential surface of the roll. As a result, such conventional adhesive tape dispensers are incapable of effectively solving the problem of adhesive tape retraction onto the adhesive tape roll.

In addition, the dispenser 90 has a forward facing fastening hook 94 at the interior rear side of one roll transport portion 93 and a rearward facing fastening hook 95 at the interior rear side of its other roll transport portion (not fully shown in the drawing). During utilization, the two fastening hooks 94 and 95 are engaged to conjoin the two roll transport portions 93. However, the design requires that the two roll transport portions 93 be radially aligned at the front and the rear and are similarly hampered by the circumferential surface of the adhesive tape roll and inconveniencing operation.

Furthermore, referring to U.S. Pat. No. 5,921,450, the invention addresses the adhesive tape retraction and sticking problem by providing an improved structure tape dispenser have a roller bar capable of rotating in a single direction or moving upward at an angle to thereby effectively prevent the tape end from retracting upon itself. However, such a design is of greater structural complexity and higher production cost.

SUMMARY OF THE INVENTION

The primary objective of the present invention is to provide an adhesive tape dispenser that prevents the end of the adhesive tape from spindling back and clinging to the circumferential surface of the adhesive tape roll to thereby increase convenience during utilization; furthermore, the present invention is structurally simple and of lower production cost.

Another objective of the present invention is to provide an adhesive tape dispenser in which the loading and unloading of the adhesive tape roll requires less effort and is more expedient.

To achieve the objectives, the adhesive tape dispenser provided by the present invention is comprised of a dispensing body of one-piece injection molded plastic construction having a front portion, two side portions respectively extending back from the left and right ends of the front portion, two roll transport portions respectively protruding inward from the interior surfaces of said side portions, and at least one check portion disposed at the front ends of the interior surfaces of said side portions. A blade is mounted on the front portion of the dispensing body. At least one tensile anti-reverse member is extended from the peripheral surfaces of the roll transport portions of the dispensing body and oriented to follow the rotational direction of the adhesive tape roll that is rotated forward in application. As such, the adhesive tape roll can be rotated forward to apply tape, but the adhesive tape roll cannot be easily rotated backward due to the braking action occurring at the rear extremity of the tensile anti-reverse member.

In addition, the tape dispenser of the present invention further comprises at least one snap-fit recess portion formed on the inner end of one of the roll transport portions, with the opposing said roll transport portion having at least one split post portion for inserting the snap-fit recess portion so as to fasten the two roll transport portions together at an appropriate degree of tightness. As such, the two roll transport portions are conjoined or separated axially along the roll of adhesive tape and are not hampered by the inner circumference of the adhesive tape roll.

DETAILED DESCRIPTION OF THE INVENTION

Figure 1:
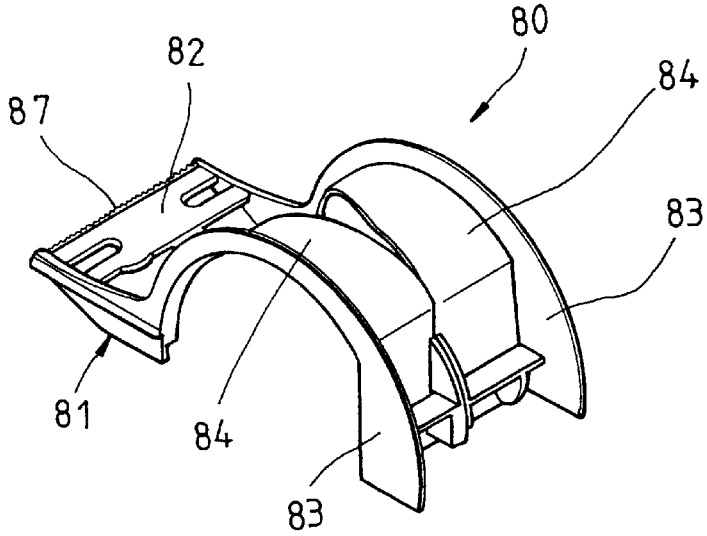
FIG. 1 PRIOR ART
FIGS. 1 and 2 are perspective views of a conventional tape dispenser.
Figure 2:
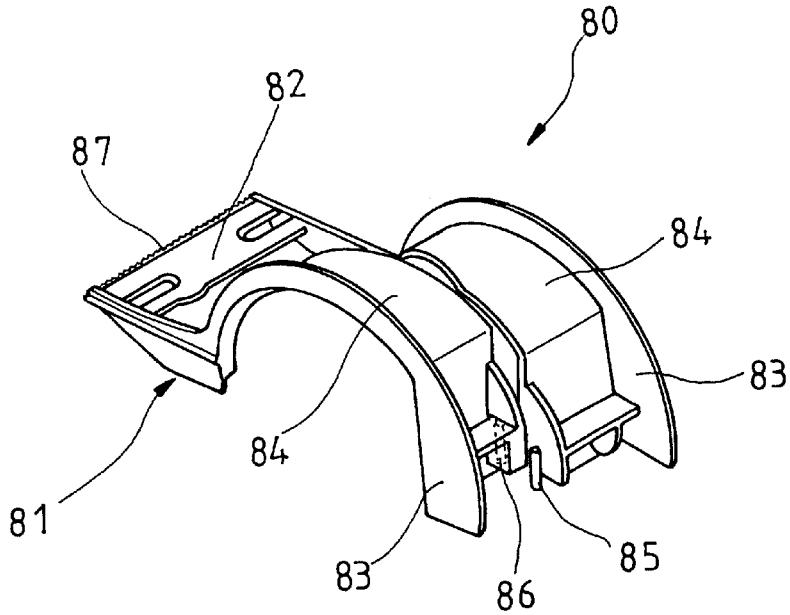
FIG. 2 PRIOR ART
Figure 3:
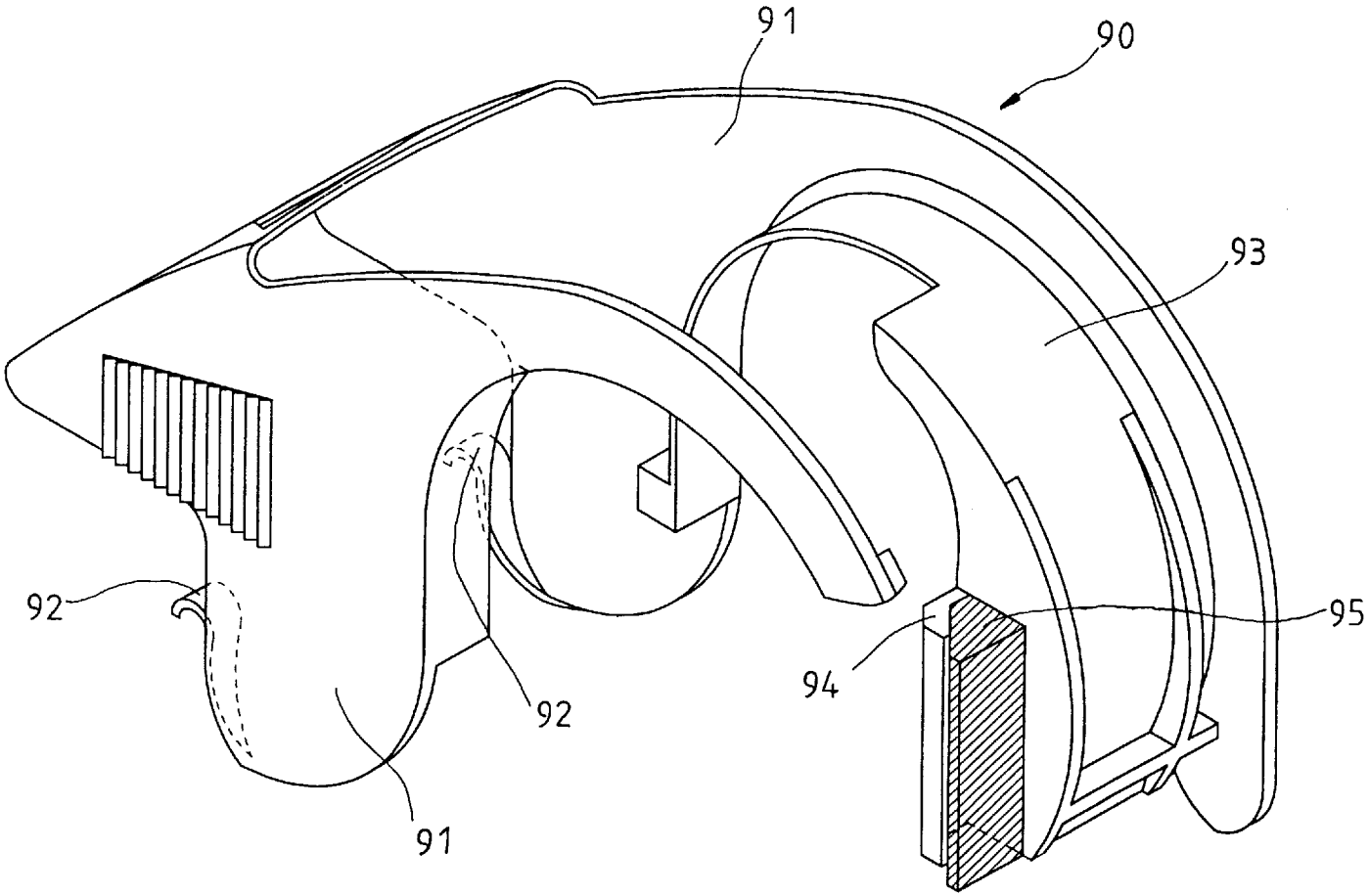
FIG. 3 PRIOR ART
FIG. 3 shows a perspective view of another conventional tape dispenser.
Figure 4:
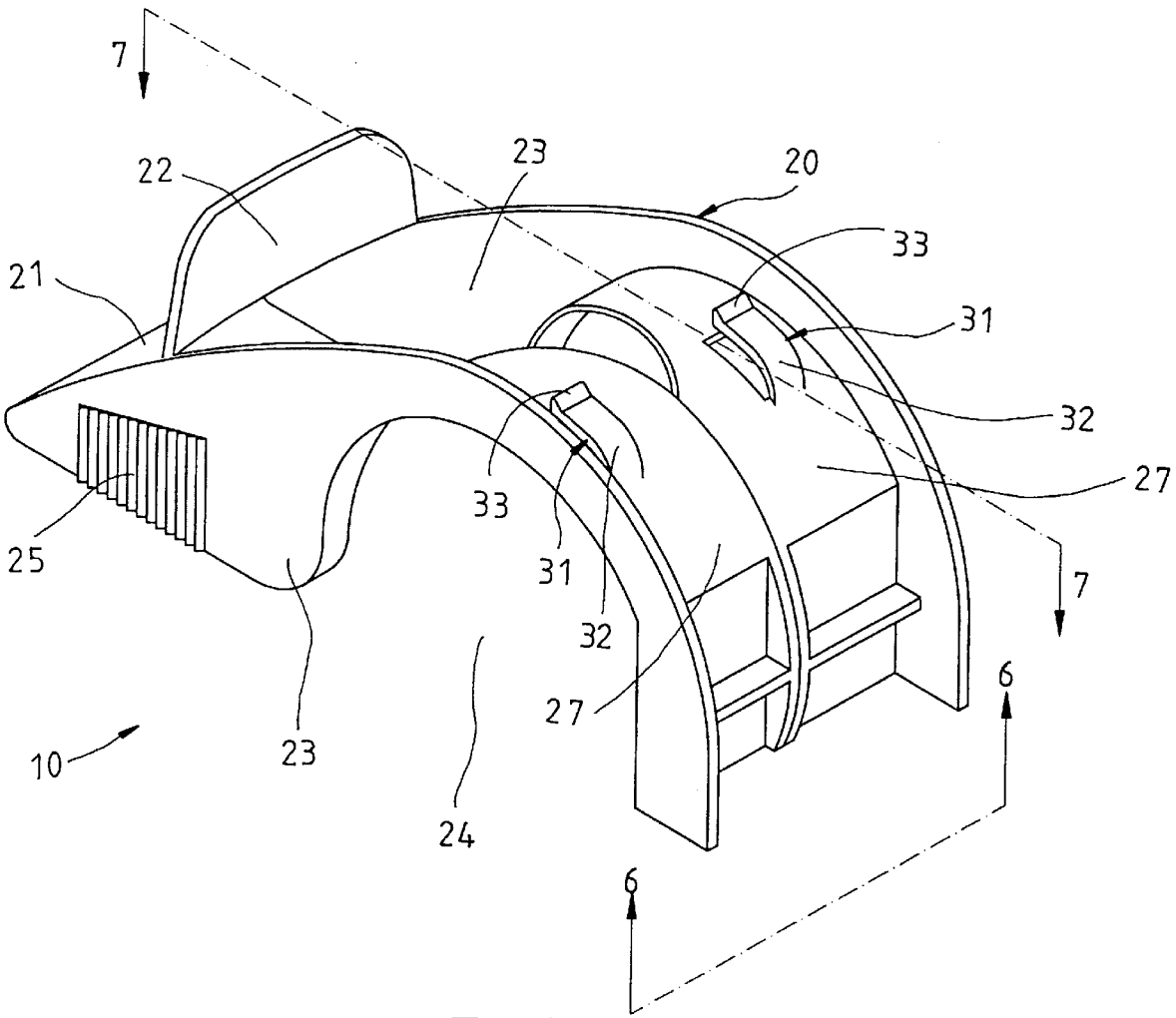
FIG. 4 is a perspective view of a preferred embodiment of the present invention.

Referring to FIGS. 4-7, an adhesive tape dispenser 10 of a preferred embodiment of the present invention comprises a plastic dispensing body 20 and a metal blade 40.

The dispensing body 20 is of one-piece injection molded plastic construction and consists of a planar front portion 21, a guard portion 22 extending upward from the rear of the front portion, a side portion 23 extending contiguously back from each of the left and right ends of the front portion 21, a semicircular opening portion 24 formed in the rear half of the gradually widening panels of each side portion 23, a coarse portion 25 disposed as a plurality of vertical lines contoured along the front exterior surface of the side portions 23 and which increases grasping friction, a short columnar check portion 26 protruding inward from inner lateral surfaces towards the front end of each of the side portions 23 and, furthermore, a roll transport portion 27 projecting inward from each interior lateral surface at the semicircular edge of the opening portion 24 in the form of a half-circumference curved extension. When not subjected to external force, the two side portions 23 of the dispensing body 20 are postured in a left, right parallel orientation and, furthermore, the inner ends of (the rear half portion) of the two roll transport portions 27 are situated against each other. Additionally, a tensile anti-reverse member 31 is disposed on the peripheral surface of each said roll transport portion 27 and each said tensile anti-reverse member 31 has a long curved portion 32 that extends from the rear to the front along the outer extent of the roll transport portion 27 and, furthermore, a retarding portion 33 rises slightly upward from its rear extremity. Furthermore, referring to FIG. 5 and FIG. 6, a connecting plate 34 extends from the left and right surfaces at the interior rear side of the two roll transport portions 27, wherein a through-hole type snap-fit recess portion 35 is formed in the surface of one connecting plate 34 and two split post portions 36 are horizontally disposed on the other connecting plate 34. The post portions 36 are separated by slight gap, each tip thereof has an upward and downward hook respectively formed and, furthermore, their tip surfaces are beveled such that the post portions 36 are inserted into the snap-fit recess portion 35 so as to fasten the two roll transport portions 27 together at an appropriate degree of tightness.

The blade 40 is mounted flat to the bottom side of the dispensing body 20 front portion 21, its front edge is serrated and extends slightly beyond the front edge of the front portion 21 and utilized to cut adhesive tape. The blade 40 mounting structure and method are accomplished by conventional techniques and, therefore, shall not be further elaborated.

The utilization method of the adhesive tape dispenser 10 provided by the present invention is basically similar to that of the prior art; the left and right sides to the rear of the two side portions 23 of the dispensing body 20 are spread apart an appropriate degree and an adhesive tape roll T of proper specification is inserted between the two roll transport portions 27 with the adhesive side of the tape facing downward, following the two side portions 23 are released to secure of the adhesive tape roll T in the two roll transport portions 27.

Figure 5:
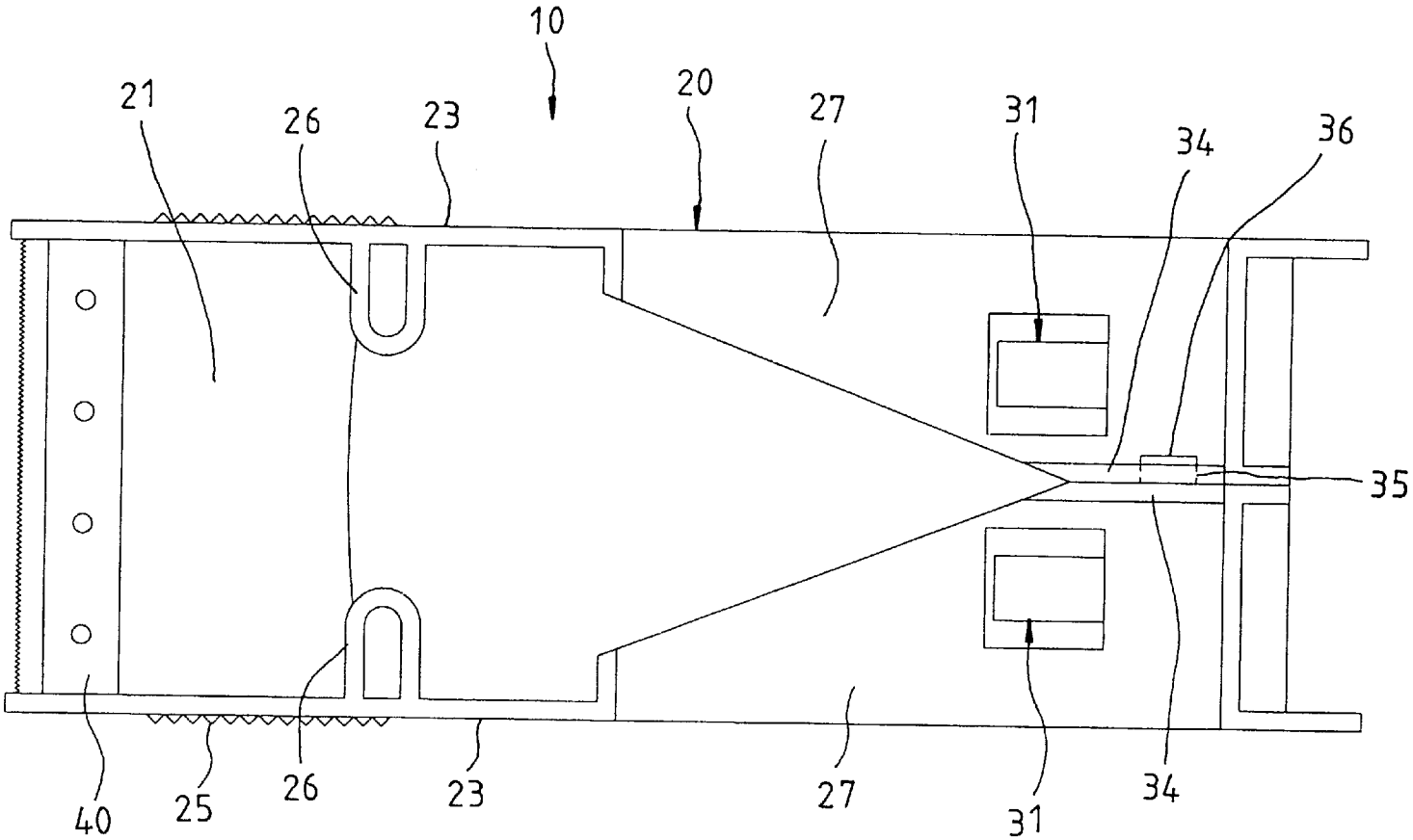
FIG. 5 is a bottom view of the preferred embodiment of the present invention.
Figure 6:
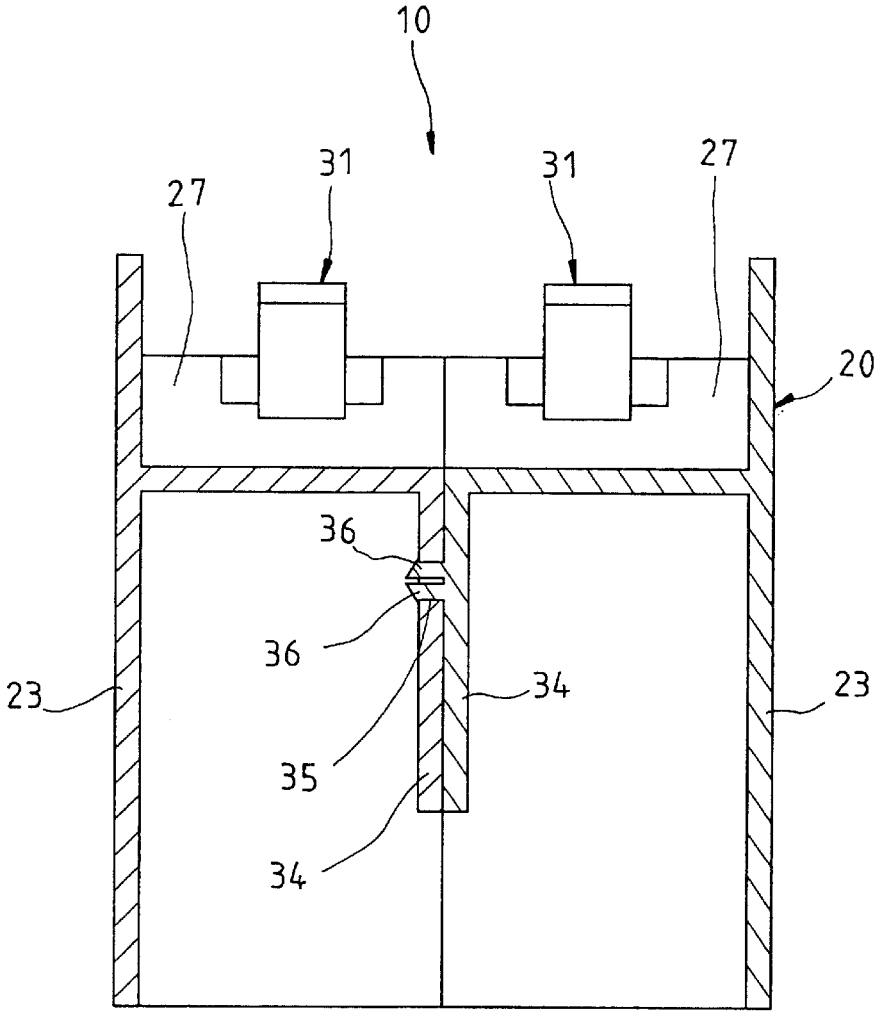
FIG. 6 is a cross-sectional view taken along line 6-6 as shown in FIG. 4.

When the adhesive tape roll T is loaded and the two roll transport portions 27 are ready to be conjoined, it is only necessary to apply inward pressure laterally against the left and right exterior aspects of the two side portions 23 such that the inner end of the split post portions 36 is squeezed into the snap-fit recess portion 35 until the hooked tips are inserted though the connecting plates 34 and then expand into a locked fastened state to thereby conjoin the two roll transport portions 27 at an appropriate degree of tightness, as indicated in FIG. 5 and FIG. 6. To remove the adhesive tape roll T requires the separation of the two roll transport portions 27, at which time the two side portions 23 are forcefully spread apart to extricate the split post portions 36 from the snap-fit recess portion 35. In the present invention, when the two roll transport portions 27 are conjoined or separated, since the roll transport portions 27 are axially oriented along the adhesive tape roll T, which remains inwardly and outwardly movable (which differs from the radial orientation of the conventional method), the inner circumferential surface T of the adhesive tape roll T is not impeded, resulting in smoother and easier operation.

In the present invention, the design of the split post portions 36 and the snap-fit recess portion 35 is not limited to said arrangement, the only requirement being that the insertion of the split post portions 36 into the snap-fit recess portion 35 maintains an appropriate degree of conjoinment tightness.

Figure 7:
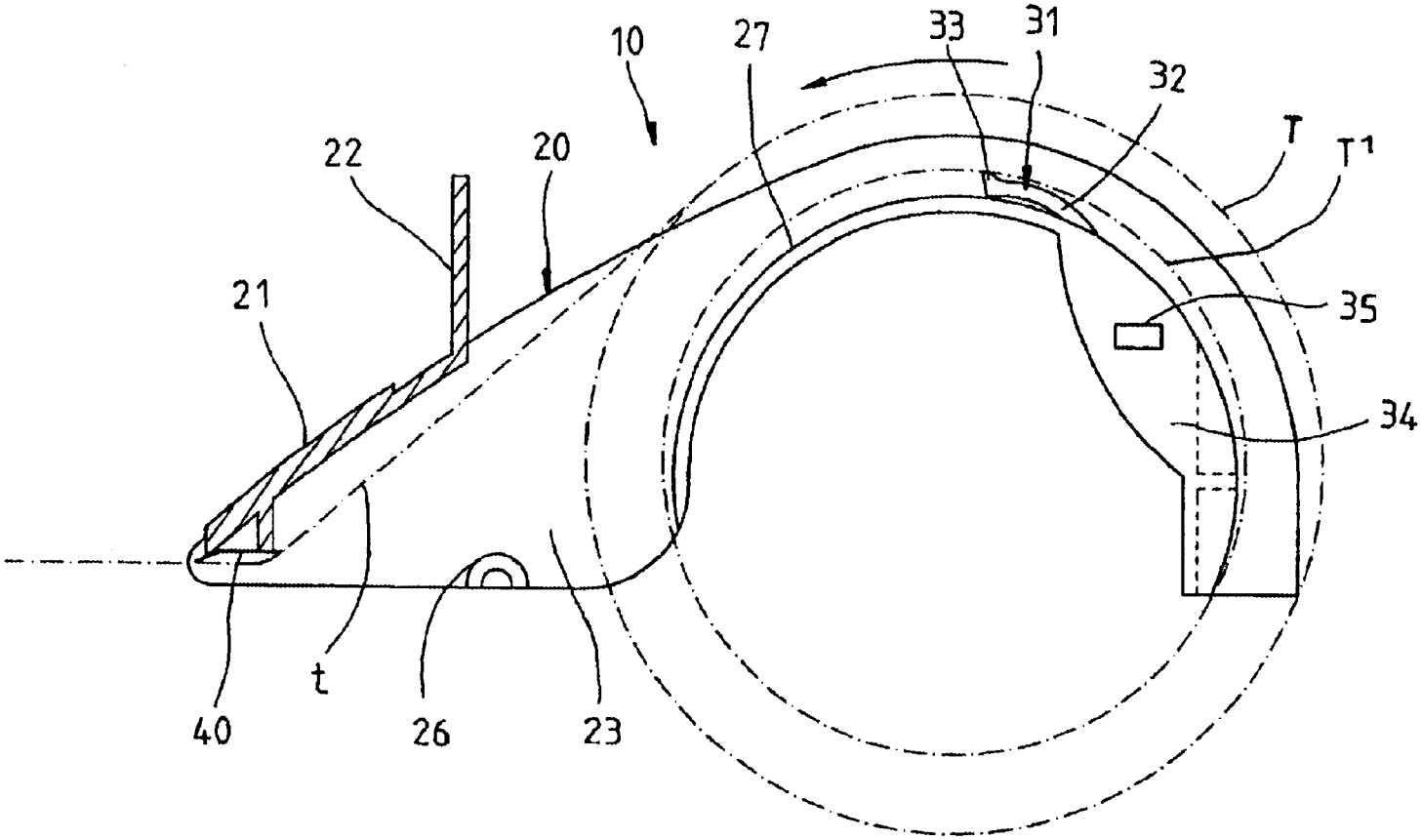
FIG. 7 is a cross-sectional view taken along line 7-7 as shown in FIG. 4, showing that a roll of adhesive tape is fitted on the dispenser and rotated in a forward direction.

Referring to FIG. 7, when adhesive tape is dispensed, a length of adhesive tape t is first pulled from the adhesive tape roll T such that the adhesive tape t passes over the two check portions 26 and, furthermore, under the front portion 21, following which the tape t is attached onto the object and the adhesive tape dispenser 10 is drawn back, causing the adhesive tape roll 10 to rotate forward (counter-clockwise rotation as shown in FIG. 7) during application. Although the two tensile anti-reverse members 31 are situated against the inner circumferential surface T of the adhesive tape roll T, the extensional orientation of the tensile anti-reverse member 31 curved portions 32 follows the rotational direction of the adhesive tape roll T and, therefore, when the adhesive tape roll T is rotated forward, the two tensile anti-reverse members 31 are angled downward in the direction of applied force and do not impede the unrolling of the adhesive tape roll T.

Figure 8:
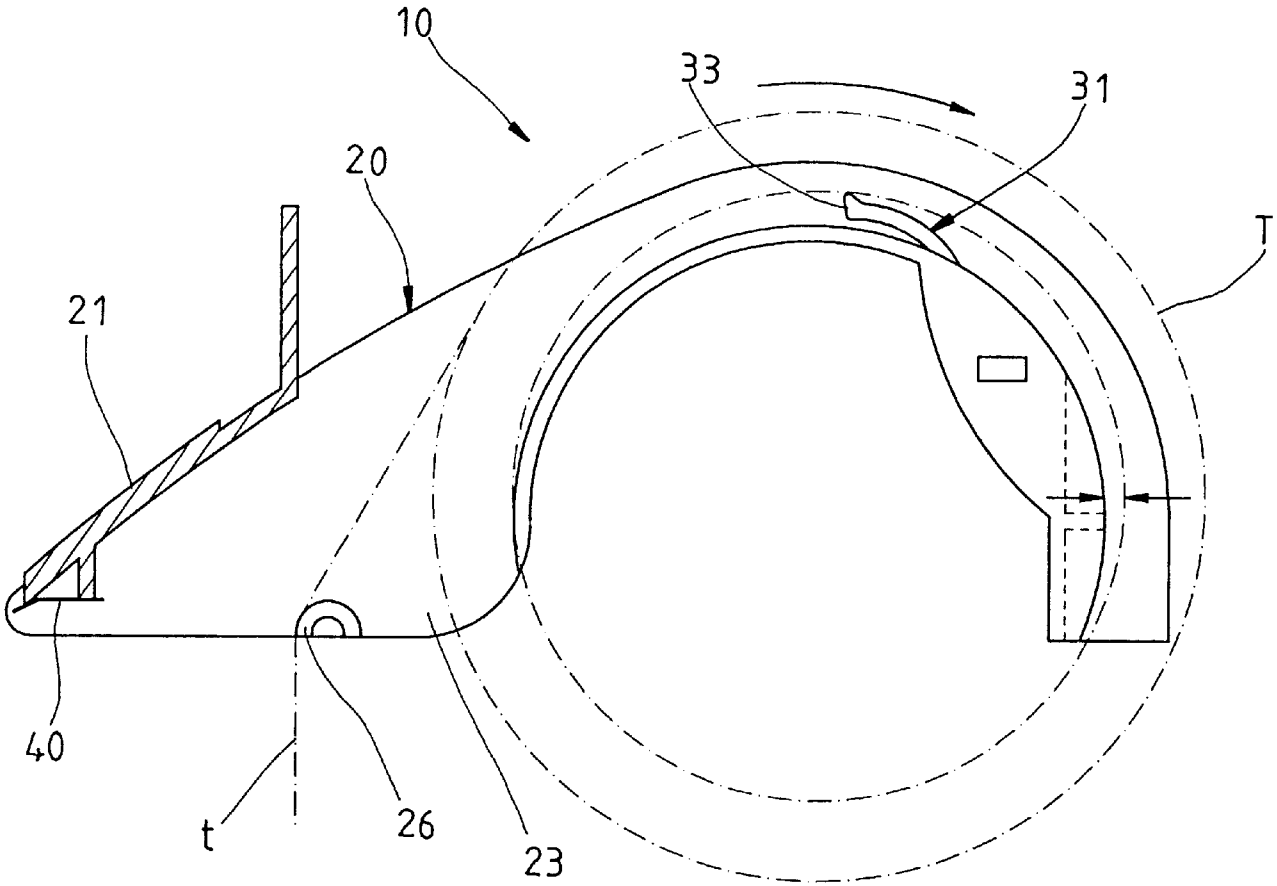
FIG. 8 is a cross-sectional view similar to FIG. 7, showing that the roll of adhesive tape is in tendency to be rotated in a backward direction.

As indicated in FIG. 8, after the adhesive tape t is cut by the blade 40, the remaining small portion pulled out hangs down onto the two check portions 26 and cannot be retracted and stick onto the circumferential surface of the adhesive tape roll T.

As further indicated in FIG. 8, when the adhesive tape roll T is in tendency to be rotated backward (clockwise rotation illustrated in the drawing) by an external force, the retarding portion 33 at the rear extremities of the two tensile anti-reverse members 31 contact the inner circumferential surface of the adhesive tape roll T such that whenever the adhesive tape roll T rotates clockwise, the rising rear extremities of the tensile anti-reverse members 31 resists such rotation in the opposite direction and, as such, the adhesive tape t is not curled back onto itself.

Based on the foregoing recitation, the adhesive tape dispenser of the present invention prevents adhesive tape retraction to enable easy and convenient tape application and, furthermore, the advantages of the tape dispenser structure of the present invention includes simplicity, fewer components, easy assemble, and lower production cost.

What is claimed is:

1. A tape dispenser comprising:

a dispensing body being of one-piece injection molded plastic construction, said dispensing body having a front portion, two side portions respectively extending back from the left and right ends of the front portion, two roll transport portions respectively protruding inward from the interior lateral surfaces of said side portions and adapted for the roll of adhesive tape having an inner circumferential surface rotatably fitting a roll of adhesive tape thereon, and at least one check portion disposed at the front ends of the interior lateral surfaces of said side portions;

a blade mounted on the front portion of the dispensing body;

at least one anti-reverse member stationarily fixed on the peripheral surfaces of the roll transport portions of the dispensing body, said tensile anti-reverse member having a curved portion extending outward from the outer periphery of the roll transport portions and oriented to follow the rotational direction of the roll of adhesive tape that is rotated forward in application, and a retarding portion rising slightly upward from the rear end of said curved portion engaged to the inner circumferential surface;

wherein the tensile anti-reverse member permits the roll of adhesive tape to be rotated forward and resists rotation of the roll of adhesive tape backward.

2. The tape dispenser as defined in claim 1, wherein each said roll transport portion is provided with one said tensile anti-reverse member.

3. The tape dispenser as defined in claim 1, wherein one of the roll transport portions has at least one snap-fit recess portion formed in its inner end, with the other said roll transport portion having at least one post portion formed on its inner end for inserting said snap-fit recess portion so as to fasten the two roll transport portions together at an appropriate degree of tightness.

4. The tape dispenser as defined in claim 3, wherein the snap-fit recess portion formed in the inner end of one of the roll transport portions is a through-hole, and there are two said post portions disposed with space thereof on the inner end of the other said roll transport portion; the tips of said post portions respectively having an upward and downward hook which end surface is beveled for inserting and hooking said snap-fit recess portion.

* * * * *